United States Patent [19]

Verkasalo

[11] Patent Number: 4,653,395

[45] Date of Patent: Mar. 31, 1987

[54] METHOD AND APPARATUS IN THE CALENDERING OF A WEB

[75] Inventor: Matti Verkasalo, Jyväskylä , Finland

[73] Assignee: Valmet Oy, Finland

[21] Appl. No.: 813,497

[22] Filed: Dec. 26, 1985

[30] Foreign Application Priority Data

Dec. 31, 1984 [FI] Finland ..... 845181

[51] Int. Cl.[4] ..... B30B 3/04

[52] U.S. Cl. ..... 100/38; 100/47; 100/93 R; 72/242; 162/206

[58] Field of Search ..... 100/35, 38, 47, 93 R, 100/917; 72/242, 243; 162/206

[56] References Cited

U.S. PATENT DOCUMENTS

| | | | |
|---|---|---|---|
| 3,604,344 | 9/1971 | Orstam | 100/35 |
| 4,290,351 | 9/1981 | Pau et al. | 100/47 |
| 4,380,954 | 4/1983 | Edele | 100/35 |
| 4,384,514 | 5/1983 | Larive et al. | 100/38 |

*Primary Examiner*—Henry S. Jaudon

*Attorney, Agent, or Firm*—Steinberg & Raskin

[57] ABSTRACT

Method and apparatus in the calendering of a web in a calender comprising a calender stack including at least two calender rolls situated substantially one over the other defining at least one calendering nip between them in which the web to be calendered is pressed at a suitable linear load, and wherein the outer rolls of the stack are provided with internal apparatus for varying or adjusting the roll crowns. The mantle of one or both of the calender rolls defining a calendering nip is heated to produce in the web passing through the nip a significant temperature differential in the thickness direction of the web between its interior portion and its surface layers and/or between its opposite surface layers. In this manner, the mechanical calendering work normally a function of the linear loading of the calender rolls is compensated for by the temperature gradient produced by the temperature differential which acts on the plastic properties of the web. The heating of the calender roll mantles is accomplished by external heating devices which at the same time adjust the axial profile of the calendering nip and the transverse thickness profile of the web by changing the radius of the roll through the variations in the temperature thereof.

22 Claims, 6 Drawing Figures

| CALENDER VARIABLES | | | | | | CALENDERING MODE | | |
|---|---|---|---|---|---|---|---|---|
| | | ROLL TEMPERATURES (°C) | | LINEAR LOADS (kN/m) | | NIP | PAPER TOP SIDE | PAPER WIRE SIDE |
| 1 | ~60°C | 70<br>70<br>70<br>70 | | 1. 66<br>2. 88<br>3. 110 | | 1.<br>2.<br>3. | KO<br>KO<br>KO | KO<br>KO<br>KO |
| 2 | ~60°C | 100<br>90<br>90<br>100 | | 1. 56<br>2. 78<br>3. 100 | | 1.<br>2.<br>3. | KO+<br>KO+<br>KO+ | KO+<br>KO+<br>KO+ |
| 3 | ~50°C | 200<br>40<br>40<br>200 | | 1. 30<br>2. 52<br>3. 74 | | 1.<br>2.<br>3. | LG<br>KO-<br>KO- | KO-<br>KO-<br>LG |
| 4 | ~50°C | 150<br>40<br>40<br>150 | | 1. 30<br>2. 52<br>3. 74 | | 1.<br>2.<br>3. | LG+KG<br>KO-<br>KO- | KO -<br>KO-<br>LG+KG |
| 5 | ~50°C | 200<br>200 | | 80 | | 1. | LG+KG | LG+KG |

FIG. 6

METHOD AND APPARATUS IN THE CALENDERING OF A WEB

BACKGROUND OF THE INVENTION

The present invention relates generally to the calendering of webs, such as the calendering of paper webs in machine-finishing operations.

In particular, the invention relates to web calendering wherein the web to be calendered is passed through one or more calendering nips formed between calender rolls, in which nips the web is pressed at a suitable linear load, and wherein at least the extreme or outer rolls are provided with internally situated means for varying or adjusting the roll crowns.

The invention further relates to apparatus for carrying out the calendering method including a machine stack comprising a calender stack including at least two, and preferably more, calender rolls which form one or more calendering nips between each other and in which an outer roll or rolls are provided with internally situated devices for varying or adjusting the crowns of the rolls.

Although the invention is described below in connection with paper webs, it will be understood that the method and apparatus of the invention are also suitable for use in the calendering of other types of webs, generally but not necessarily fibrous webs.

Paper coming from the drying section of a paper machine is usually not yet suitable for its intended purpose but, rather, requires various additional treatment steps.

An important post-manufacturing treatment of paper is calendering which, when performed as a separate working step, is generally referred to as machine-calendering or super-calendering. In machine calendering, the web is passed through one or more press zones or nips formed by rolls having hard and smooth surfaces. In the case where the web is passed through several nips, the calender rolls are usually journalled one above the other so that they can freely move in the vertical direction with respect to the bottom roll which is mounted with a fixed axis of rotation, to thereby form a multi-roll vertical calender Important goals of calendering are to provide the paper with the desired smoothness and glaze and to adjust the thickness and bulk of the paper to desired levels. A related object is to equalize the thickness of the web in the transverse direction so that wound rolls of the web are even. Other functions are carried out by calendering, as are well known.

The calendering of webs have been compared to the ironing of cloth by means of a steam iron in that pressure, temperature and moisture are important factors along with the nature of the contact of the web with the calender rolls. The basic nature of the work performed by a calender or machine stack is rolling friction whereby deformation in the web is accomplished mainly by compression forces.

More particularly, the effectiveness of calendering on a web depends on a great number of factors, notably the surface pressure present in the press zone, which depends on the linear load in the nip, on the diameters of the calender rolls, on the thickness of the web, on the number of nips, and the temperature of the rolls, on the moisture of the paper and the distribution of the moisture in the cross-section of the paper, and on the speed of the machine.

The surface pressure present in the press zone is an important variable in the calendering operation. The higher the pressure, the higher is the effect of the calendering on the thickness and smoothness of the paper. On the other hand, an excessively high pressure may damage the web. For those paper qualities that require intensive calendering, the surface pressure is generally in the range of between about 20 to 50 MPa in the lowermost calendering nip. The number of nips is also significant.

The temperature of the rolls also affects the calendering operation. A high temperature will improve the smoothness of the paper and it is conventional to heat some of the calender rolls by steam or heated water.

The water content of the paper is also an important factor in calendering. Generally, increased water content in the paper web improves its smoothness but reduces the thickness, brightness and opacity of the paper. An excessively high water content causes the web to blacken due to the crushing of the fibers in the regions where they are linked together. Generally, calendering should be performed with the paper having a water content of between about 5 to 8%, although the calendering of newsprint as well as certain other printing papers which contain groundwood pulp can be performed with a water content of up to 9%.

It is conventional to dry certain types of cardboard to an excessive dryness whereupon the same are moistened at the calender to a desired water content. The water is added to the surface of the board either by means of a mist jet before the first nip or by means of a water doctor placed on one or more calender rolls. The water moistens only the surface layer of the board whereby it is possible to obtain a high degree of smoothness without compressing the board to an undue thinness.

The effect of calendering on a web also depends on the speed of the machine. Generally, the effectiveness of the calendering is reduced as the machine speed increases. This decrease in effectiveness can be compensated for by increasing the linear load in the nips, by increasing the number of nips, or by raising the temperature.

Moreover, the calendering of webs in high speed paper machines often results in detrimental barring of the web which is difficult to avoid. Specifically, patterns of transverse depressions or bars are formed in the web which are clearly visible and which repeat at regular intervals. Such bar patterns are also clearly visible in the thickness profile of the web in the machine direction. Barring results from oscillations of the calender which cause variations in the linear load in the nips.

Ideal conditions in which the linear load across the web is constant in each nip of the calender and in which the properties of the web being introduced into the calender, such as thickness, density, moisture, formation and the like, are uniform both in the longitudinal as well as in the transverse direction, never actually occur in practice. Thus, in practice, the calender rolls cannot be ground so as to be perfectly straight nor does the convexity curve of the rolls precisely follow their deflection curve. Variations in the properties of the paper web result from both the wet end as well as from the drying section of the paper machine. In order to compensate for these practical problems, adjustments must be made in the operation of the calender. One possibility is the adjustment of the temperatures of the calender rolls at different portions of the web along its transverse dimension.

If a region of the web in the machine direction is thicker than other regions, an increased linear load will exist in the calender nip at this region. In this manner, additional heat is generated in this region relative to other transverse regions so that the temperature of the calender rolls is elevated whereby the diameter of the rolls increases due to thermal expansion to cause even further generation of heat. Thus, the calender normally has a tendency to self-correct the transverse thickness profile of the web. Such self-correction is, however, generally not sufficient and corrections in the thickness profile must be made by other provisions, such as localized heating or cooling of the calender rolls.

Arrangements are known in the prior art for heating the calender rolls by electromagnetic induction whereby a magnetic flux is externally applied to the mantle of the calender roll by means of a magnetic shoe device spaced from the calender roll mantle by an air gap. Magnetic flux induces eddy currents in the roll mantle which in turn generate heat in the mantle due to the electrical resistance of the mantle. Such known magnetic shoe devices include several core components situated in side-by-side relationship which can be adjusted to in turn adjust the heating effect of the cores in the axial direction of the calender roll. With respect to the technique for induction heating of calender rolls, reference is made by way of example to Finnish patent application Nos. 812697, 820733, 821838 and 824281. Reference is also made to Finnish application Nos. 833589 and 843412, assigned to the assignee of the instant application.

SUMMARY OF THE INVENTION

It is an object of the present invention to provide new and improved web calendering methods and apparatus.

Another object of the present invention is to provide new and improved web calendering apparatus which to a large extent eliminate drawbacks which result from high speed operation of conventional calenders, particularly newsprint calenders, such as increased roughness of the web surface and increased barring of the web. In this connection, it is well known that rates of production from paper machines have dramatically increased in recent years as have the width of such machines, thereby imposing increased requirements on machine stacks or supercalenders.

Still another object of the present invention is to provide new and improved web calendering methods and apparatus, particularly for the calendering of newsprint, wherein the mechanical loading of the paper in the calender nips is reduced, compensation for the reduced loading taking the form of intensifying the share of the calendering that utilizes the plastic properties of the paper.

Still another object of the present invention is to provide an arrangement by means of which existing calenders presently in operation, e.g. conventional four-roll calenders, can be easily converted to calenders which can operate in accordance with the method of the invention in a simple manner and at a relatively low cost.

Briefly, in accordance with the present invention, these and other objects are attained by providing an arrangement wherein the cylinder mantle of one or both of the opposed calender rolls defining a calendering nip is heated to an extent such that, in the direction of thickness of the web passing through the nip, a significant temperature differential is produced between its interior portions and its surface layers and/or between its opposed surface layers. By this technique it has been found that the mechanical calendering work normally a function of the linear loading of the calender rolls can be reduced with compensation being in the form of a temperature gradient in the web produced by the temperature differential acting upon the plastic properties of the web.

In accordance with the invention, the cylinder mantle of one or more calender rolls is heated by means of external heating devices by which the axial profile of the calendering nip in the transverse thickness profile of the web to be calendered are adjusted under the effect of the changes in the radius of the calender roll produced due to the variations in the temperature thereof.

According to the apparatus of the invention, one or more of the calender rolls, and preferably the top and bottom calender rolls, are provided with external heating devices situated in non-contact relationship with the corresponding calender rolls and by means of which the cylinder mantle of the respective calender roll is heated to the temperature required to obtain the temperature gradient in the web which will act on the plastic properties of the web to an extent such that the linear loading of the calender rolls can be reduced. The heating devices are arranged to act as means for adjusting the transverse profile of the web.

A calender operating in accordance with the invention can be referred to as a "gradient calender" since the invention utilizes a difference in temperature in the thickness direction of the web and, in some embodiments, also utilizes differences in moisture content of the web in the thickness direction thereof, i.e., the invention utilizes a temperature gradient and possibly also a moisture gradient in the calendering of the web.

Several important advantages are obtained when the temperature differential in the thickness direction of the web to be calendered in accordance with the invention is obtained by adjustable heating devices, preferably induction heating devices situated in non-contacting relationship with the calender roll, situated externally of the calender roll. Firstly, by means of such heating devices, the transverse profile of the calender nips and, therefore, the thickness profile of the web to be calendered, can be controlled. Secondly, the use of external heating devices allows the space within the roll mantle to remain free to accommodate conventional crown-variation or crown adjustment devices, which devices are generally necessary in calendering operations. In conventional steam-heated calender rolls, it has not been possible to use such devices. Further, such heating devices also make it possible to obtain sufficiently high temperature differential to obtain the objects of the invention, e.g. reduction in mechanical loading within the nips, and also allow the transverse profile of the nip to be controlled with a sufficiently high accuracy.

In one preferred embodiment of the invention, a cooling roll is used in connection with the web entering the calender in order to produce a sufficiently high temperature differential.

In certain preferred embodiments, one or more intermediate rolls of the calender are coupled to sources of cooling or heating medium for the purpose of controlling the temperature gradient.

DESCRIPTION OF THE DRAWINGS

A more complete appreciation of the present invention and many of the attendant advantages thereof will be readily understood by reference to the following detailed description when considered in connection with the accompanying drawings in which:

FIG. 6 is a table showing various combinations of calender variables and modes of calendering in prior art arrangements and in preferred embodiments of the invention.

DESCRIPTION OF THE PREFERRED EMBODIMENTS

Figure 1:
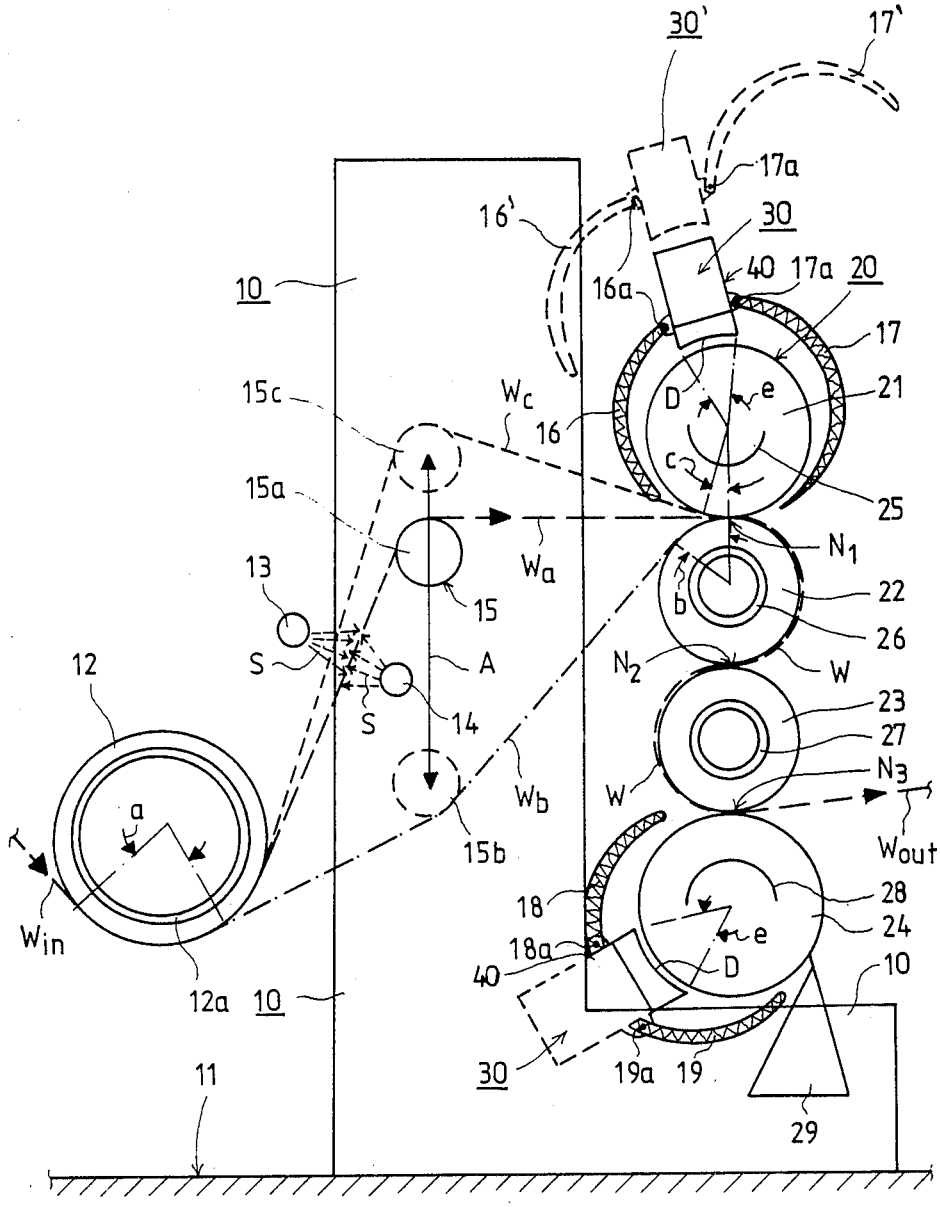
FIG. 1 is a schematic side elevation view of a calender in accordance with the invention for performing a method in accordance with the invention.

Referring now to the drawings wherein like reference characters designate identical or corresponding parts throughout the several views, and more particularly to FIG. 1, a calender in accordance with the invention comprises a calender stack 20 including an uppermost end roll 21, a pair of intermediate rolls 22 and 23 and a lowermost end roll 24, the rolls being journalled in conventional support and loading devices (not shown) mounted on a frame 10 supported on a base 11. The end rolls 21 and 24 are provided with crown variation or adjustment devices 25 and 28 situated within respective rolls 21 and 24 which operate either by means of a pressure medium and/or magnetically as is conventional. A doctor 29 is provided for the lower end roll 24. The intermediate rolls 22 and 23 preferably comprise double-mantle thermal rolls which are provided with fluid couplers 26 and 27 which communicate the interior spaces of intermediate rolls 22 and 23 with a source of heating or cooling medium such, for example, as a circulating water system.

Figure 4:
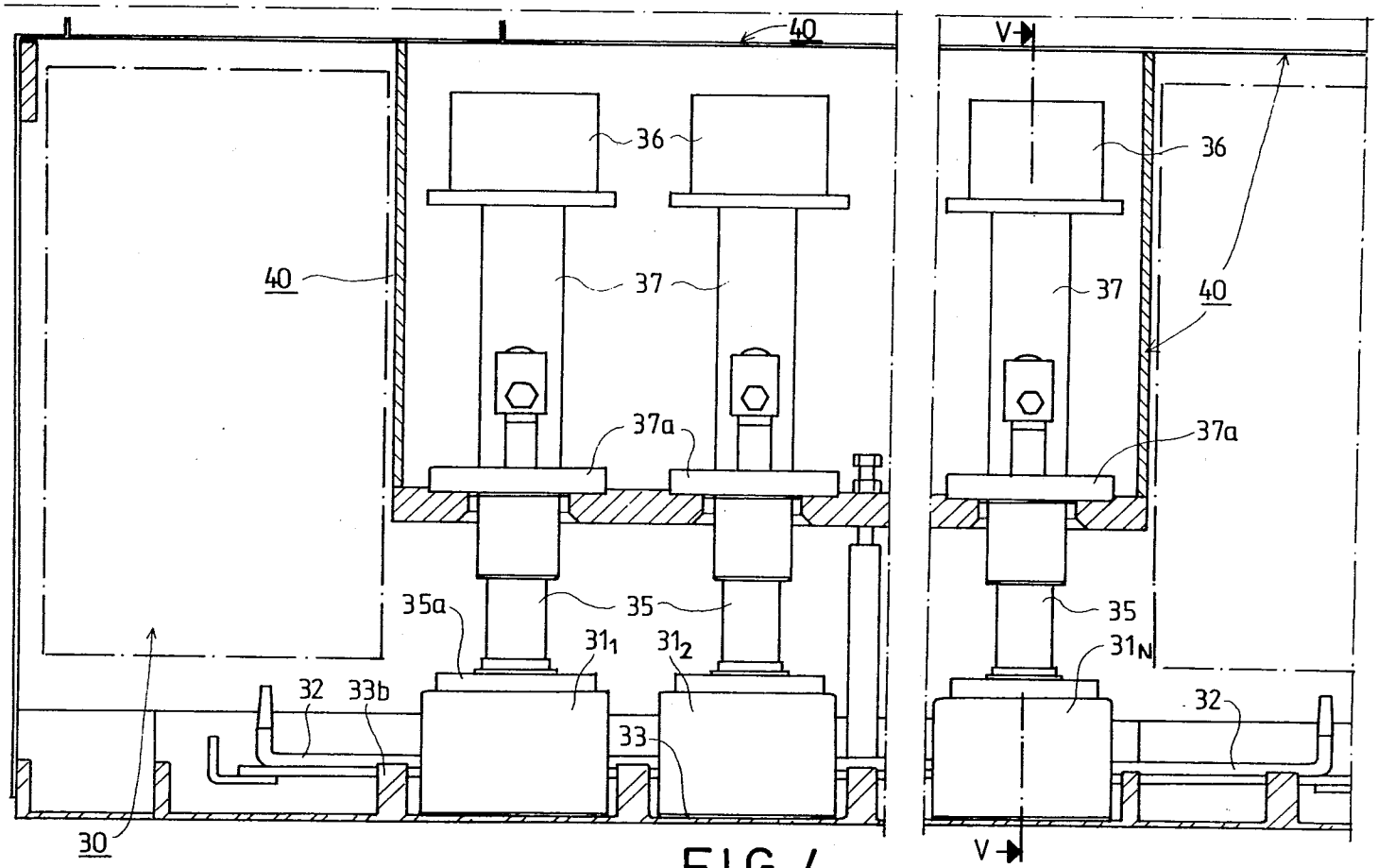
FIG. 4 is a transverse sectional view of an adjustable magnetic shoe device for use in apparatus in accordance with the invention.
Figure 5:
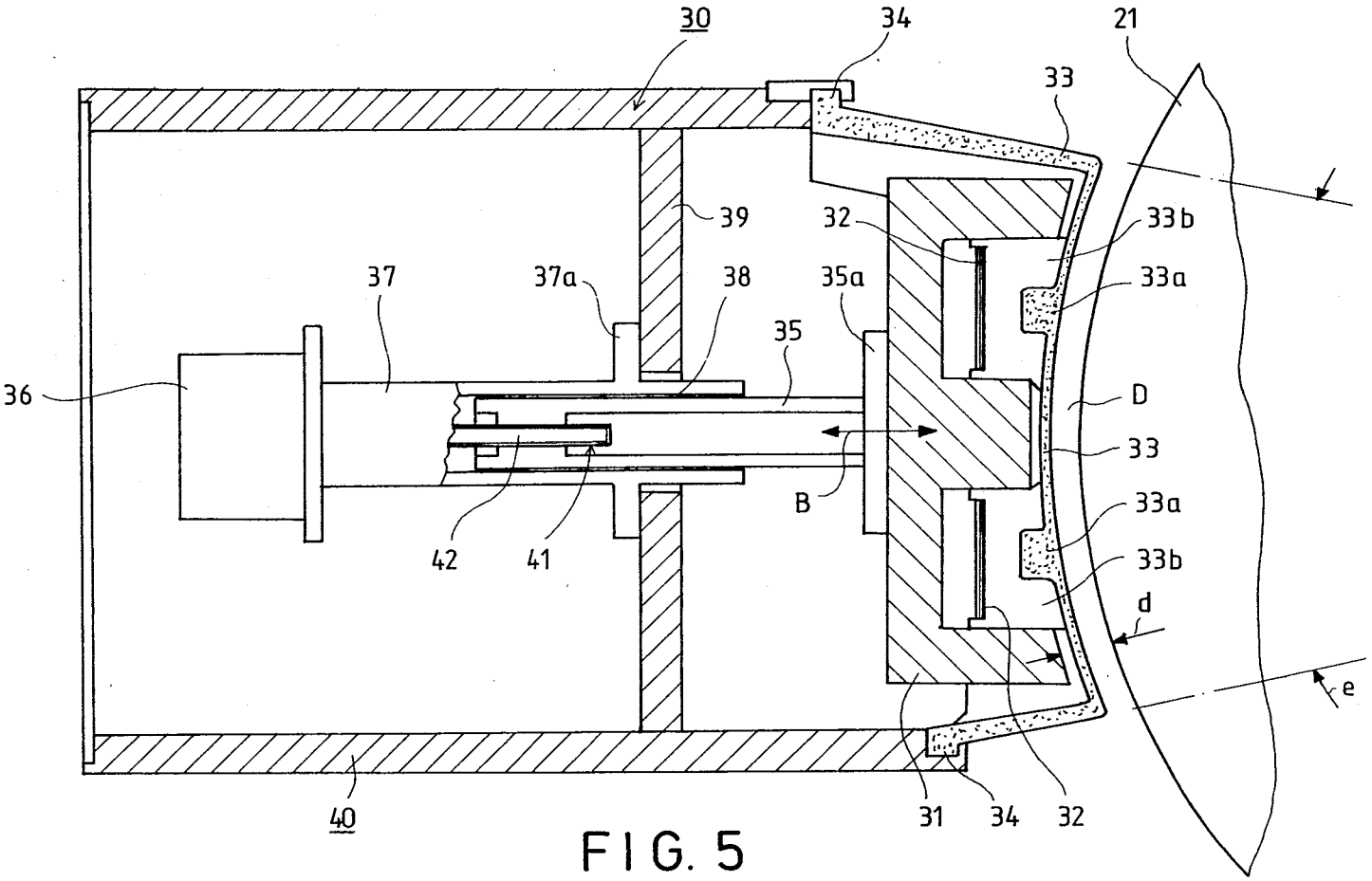
FIG. 5 is a section view taken along line V—V of FIG. 4.

External heating devices 30, described in detail below in connection with FIGS. 4 and 5, are provided for the upper and lower end rolls 21 and 24. The heating devices 30 heat the mantles of rolls 21 and 24 by electromagnetic induction. Thus, each heating device 30 includes a series of magnetic shoes 31 (FIG. 4) situated in non-contacting relationship with a respective roll which apply a magnetic flux to the roll mantle within a sector e through an air gap D. The magnetic flux induces eddy currents in the roll mantle which is made of a ferromagnetic material. The eddy currents produce a heating effect due to the resistance of the mantles of rolls 21, 24. The depth to which the heating effect penetrates within a roll can be adjusted in a known manner by regulating the frequency of the magnetizing current. In this connection it is preferable to maintain the frequency of the magnetizing current at a sufficiently high level so that the heating effect penetrates to a sufficient depth. In this connection reference is made to Finnish patent application No. 833587 filed Oct. 3, 1983. A high degree of penetration of the heating effect also increases the accuracy and speed of the adjustment.

Heating devices 30 extend over substantially the entire axial lengths of the uppermost and lowermost end rolls 21 and 24. The heating device 30 associated with the uppermost end roll 21 is mounted on shifting devices (not shown) by means of which the heating device 30 can be moved to an upper position 30' shown in phantom in the event of web breakage or for other servicing. A pair of curved insulation elements 16 and 17 are pivotally linked to the frame 40 of the upper heating device 30 by means of pivot shafts **16*a* and 17*a*. Similarly curved insulation elements 18 and 19 are pivotally connected to the frame 40 of the heating device 30 associated with lower end roll 24 by means of pivot shafts 18*a* and 19*a*. The insulation elements can be pivoted to open positions 16' and 17' in the case of web breakage or for other servicing so that broke can be removed and to allow the calender rolls and other equipment to be serviced. The thermal insulation elements 16-19 extend substantially over the entire axial length of the calender rolls 21 and 24**.

Figure 2:
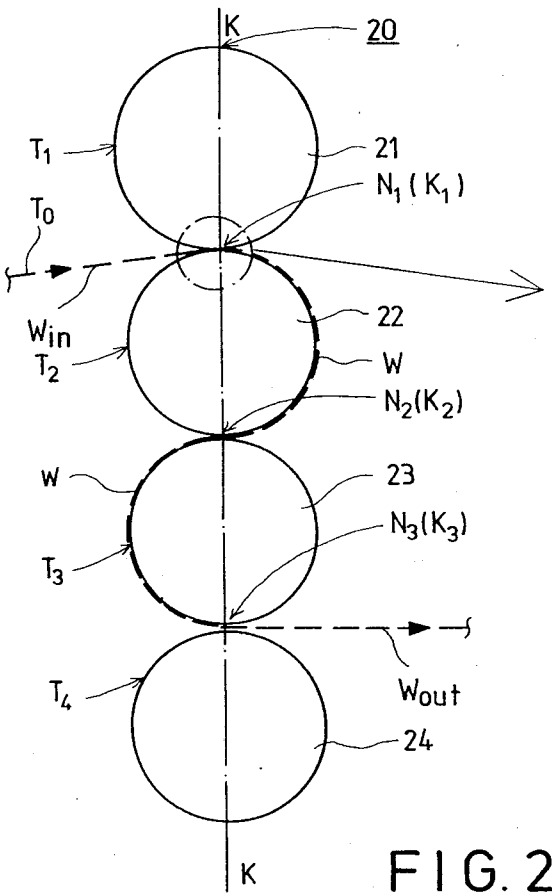
FIG. 2 is a schematic side elevation view of a calender stack showing various operational parameters.

Referring to FIGS. 1 and 2, the incoming web W arriving at the calender from the paper machine drying section is designated $W_{in}$ and the web leaving the calender is designated $W_{out}$. The web $W_{in}$ passes over a relatively large sector a of a cooling roll 12 at the inlet side of the calender. The cooling roll 12 includes a double mantle which communicates through a coupling **12*a* with a cooling medium, such as water. After passing over cooling roll 12, the web W can take one of many paths to the calender stack 20, three possible runs $W_a$, $W_b$ and $W_c$ being shown. The direction of run of the web W to the calender stack is determined by positioning a guide roll 15 in one of several positions, the three positions corresponding to the illustrated runs of the web W being designated 15*a*, 15*b* and 15*c*. The guide roll 15 is mounted to the frame 10, such as by means of lever arms and/or guide devices, so that the position of the roll 15 can be varied over sufficiently wide limits in the direction of arrow A. By adjusting the guide roll 15 in the direction of arrow A, the direction in which the web W enters into the first calender nip $N_1$ defined between rolls 21 and 22 is determined. For example, with guide roll 15 being positioned at 15*a*, the run $W_a$ of the web passes tangentially into the nip $N_1$. With roll 15 being positioned at 15*b*, the run $W_b$ enters into the first nip $N_1$ after passing over a sector b of intermediate roll 22. The magnitude of sector b can be adjusted by changing the position of guide roll 15. With the guide roll 15 being positioned at 15*c*, the run $W_c$ of the web passes into the first nip $N_1$ after passing over a sector c of the uppermost end roll 21 and the extent of sector c can be adjusted by suitably positioning the guide roll 15**. By adjusting the extent of sectors b and c, it is possible to control the temperature gradient developed in the web in accordance with the invention as well as the formation and the mode of action of the gradient as described below.

Moistening devices 13 and 14 are provided on both sides of the runs $W_a$ and $W_c$ of the web W prior to the guide roll 15. Water jets S are sprayed by devices 13, 14 on one or both faces of the web W to produce a suitable moisture gradient in the thickness direction of the web. Moistening is, however, not required in all modes of running.

Referring to FIG. 2, the calender stack 20 has a vertical plane of symmetry K—K in which the nips $N_1$, $N_2$ and $N_3$ are situated. If required, the calender rolls in stack 20 may be offset with respect to plane K—K as is conventional. The surface temperatures of the mantles of rolls 21, 22, 23 and 24 are designated $T_1$, $T_2$, $T_3$ and $T_4$ respectively. Similarly, the linear loads in the nips $N_1$, $N_2$ and $N_3$ are designated $K_1$, $K_2$ and $K_3$ respectively. The temperature of the web W entering the first calendering nip $N_1$ is designated $T_0$.

Suitable ranges of the temperatures $T_0$, $T_1$, $T_2$, $T_3$ and $T_4$ and of linear loads $K_l$, $K_2$ and $K_3$ are set forth in the following table:

| T (°C.) | | | | | K (kN/m) | | |
|---|---|---|---|---|---|---|---|
| $T_0$ | $T_1$ | $T_2$ | $T_3$ | $T_4$ | $K_1$ | $K_2$ | $K_3$ |
| 40–50 | 150–200 | 40–50 | 40–50 | 150–200 | 20–80 | 40–100 | 60–120 |

The elevated temperatures $T_1$ and $T_4$ (150°–200° C.) for the end rolls 21 and 24 are produced by the heating devices 30 by means of which it is also possible to control the temperature profile in the axial direction of rolls 21 and 24. The temperatures $T_2$ and $T_3$ (40° to 50° C.) of the intermediate rolls 22 and 23 may possibly be obtained without any particular heating or cooling of those rolls although the intermediate rolls can be heated or cooled if necessary.

Figure 3:
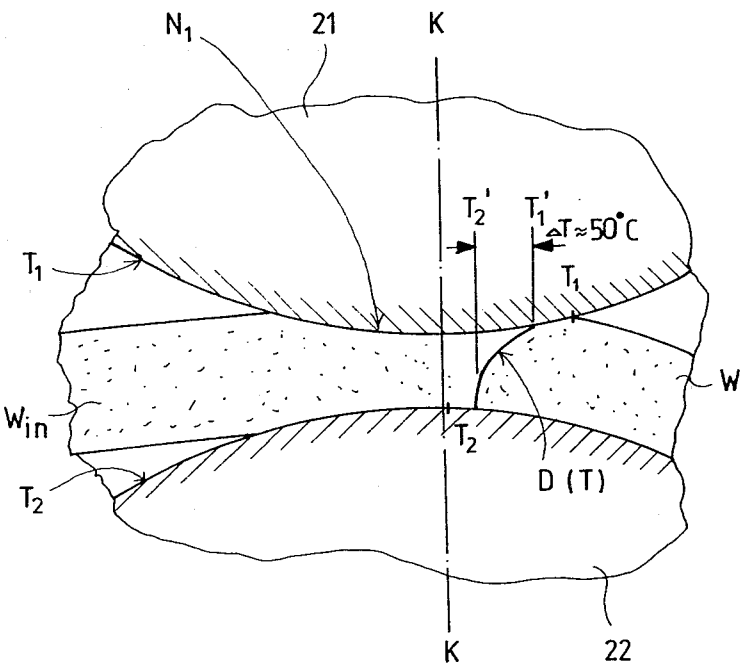
FIG. 3 is an enlarged view of the first calendering nip of the stack illustrated in FIG. 2.

The formation of a temperature gradient in the thickness direction of the web W in the first calendering nip $N_1$ is illustrated in FIG. 3. The web spends an insufficient amount of time in the nip $N_1$ for the temperatures of the outer surfaces of the web to reach the surface temperatures $T_1$ and $T_2$ of the rolls 21 and 22. However, the opposed web faces reach certain lower temperatures, designated $T_2'$ and $T_1'$ whose difference $T_1'-T_2'=\Delta T=50°$ C. represents an example of the temperature gradient which obtains the favorable effects of the invention on the plastic properties of the fiber network of the web W to be calendered. The temperature of the inner portions of the web W remains substantially at the initial temperature $T_0$ of the entire web before it enters into the first nip $N_1$. For example, the temperature $T_0$ is about 40° C. Temperature $T_0$ can be adjusted by means of cooling roll 12.

The temperature gradient produced in the web W in the first nip $N_1$ can be controlled to some extent by means of adjusting the sectors b and c. When the uppermost roll 21 is heated as shown in the illustrated embodiment, the temperature $T_1'$ of the top face of the web W is higher when guide roll 15 is situated at a higher position.

Referring to FIGS. 4 and 5, an embodiment of a heating device in accordance with the invention is illustrated. Such a heating device is placed in association with one or both of the end rolls 21 and 24 of the calender and in certain applications, if required, also in connection with other rolls, i.e., the intermediate rolls. Several heating devices may, if required, be associated with a single calender roll. As noted above, the mantle of roll 21 and/or roll 24 is made of appropriate ferromagnetic material selected in accordance with the strength requirements for the rolls 21, 24 and in view of the inductive heating to be obtained. By providing the heating devices 30 as external heating devices, the spaces in the interiors of the rolls 21 and 24 remain available to accommodate devices for varying or adjusting the crowns of the rolls.

Heating device 30 comprises serveral core components $31_1$, $31_2$. . .$31_N$ situated in side-by-side relationship and whose positions with respect to the roll are independently adjustable in the direction of arrow B (FIG. 5) for adjusting the magnitude d of the air gap D between the front face of the core components 31 and the rolls 21 and 24. Thus, the magnitude d of the air gap D can be adjusted, such as within a range of between about 10 and 60 mm. The core components 31 are provided with a common magnetizing coil 32 which is supported on a box portion 33 by means of projections **33*b*. An AC current of a sufficiently high frequency E is supplied to the coil 32** and by adjusting the frequency f of the magnetizing current, the depth of penetration of the induction heating effect can be adjusted, such as in the manner disclosed in Finnish patent application Nos. 833589 and 843412, assigned to the assignee of the instant application. Reference is made to these patent applications with respect to the level and the control of the distribution of the heating effect as well as to the regulation thereof.

As noted above, the position of each core component 31 can be independently adjusted with respect to the positions of the other core components 31 to adjust the magnitude d of the air gap D and the axial distribution of the heating effect. For this purpose, the core components 31 are attached by flanges **35*a* to arms 35 which are slidingly fitted in guide tubes 37 and 38. Screws 42 operated by motors 36 are connected to the arms 35 by means of screw threads 41. The motors 36 are connected to a control system (not shown) in a conventional manner. By setting the air gaps d between the core components 31 and the calender rolls and/or by setting the level of the magnetizing current applied to the coil 32, it is possible to control the temperature level $T_1$ and $T_4$ of the mantles of rolls 21 and 24. Moreover, through the individual adjustment of the positions of the core components 31**, it is possible to control the axial termperature profile of each roll to adjustably vary the radius of the roll along its axial dimension in order to control the nip profile and the thickness profile of the nip W being calendered.

The core components 31 are situated within a protective box 33 which is attached to the frame 40 by means of a groove-projection fitting 34. The frame 40 of the heating device 30 can be either fixed to the frame part 10 of the calender or to support devices by means of which the heating device 30 can be shifted to the position 30' in FIG. 1 for servicing or the like.

Referring to FIG. 6, examples of conventional calendering along with examples of calendering in accordance with the invention are set forth. The first column gives the number of the particular example and the second column, the configuration and temperature of the incoming web is illustrated. In the third column the temperatures of the calender rolls are indicated and in the fourth column the calender configuration is shown. The fifth column indicates the loads in the respective calendering nips. Under the heading "calendering modes", the numbers of the nips are indicated while in the next two columns, the calendering code of the top and wire sides of the web are set forth. The calendering code set forth in the last two columns in FIG. 6 have the following meanings:

KO is conventional calendering;

KO− is conventional calendering at a temperature lower than usual;

KO+ is conventional calendering at a temperature higher than usual;

LG is calendering in accordance with the invention based on temperature gradient; and KG is calendering in accordance with the invention based on moisture gradient.

Examples 1 and 2 in FIG. 6 illustrate that a calender arranged in accordance with the invention can also be used in conventional calendering techniques.

Examples 3, 4 and 5 illustrate temperature gradient calendering operations in accordance with the invention, some of which are also associated with moisture gradient control. Example 5 illustrates that a temperature differential is not necessarily required to exist between the opposed faces of the web since the temperature gradient used in the invention is obtained in example 5 based on the difference in temperatures between the intensively heated rolls ($T_1=T_2=200°$ C.) which heat the opposed faces of the web W and the temperature of the interior portions of the web W ($T_0=50°$ C.).

It should also be noted from examples 1 and 2 of FIG. 6 which illustrate conventional calendering, that the linear loads in the calendering nips are significantly higher than in examples 3 and 4 of the invention. This emphasizes the favorable effects of the invention, namely, that in the invention the amount of mechanical calendering work, i.e., the calendering work based on compression pressure, can be reduced and be compensated for by a calendering effect based on a temperature gradient, and possibly additionally on a moisture gradient, through the effect based on the plastic properties of the paper web.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method in the calendering of a web in a calender comprising a calender stack including at least two calender rolls situated substantially one over the other defining at least one calendering nip between them in which the web to be calendered is pressed at a suitable linear load, said stack of calender rolls including outer rolls provided with internal means for variably adjusting the crowns thereof, comprising the steps of:

providing means for heating the mantle of at least one of said calender rolls defining a calendering nip, said heating means being situated externally of said calender rolls heated thereby;

heating the mantle of said at least one of said calender rolls defining a calendering nip by said heating means to produce in the web passing through said nip a significant temperature differential in the thickness direction of said web between its interior portion and its surface layers and/or between its opposite surface layers to produce a temperature gradient over the thickness of the web;

acting on the plastic properties of said web to be calendered by means of said temperature gradient in said web based on said temperature differential to compensate for mechanical calendering work based on linear loading of said calender rolls; and adjusting the axial profile of said calendering nip and the transverse thickness profile of said web by changing the radius of said at least one of said calender rolls by varying its temperature utilizing said heating means.

2. The method of claim 1 further including the step of cooling said web before it passes into a first one of said calendering nips in said calender, said web being cooled to a temperature which is sufficiently low to provide said significant temperature differential.

3. The method of claim 1 further including the step of controllably moistening at least one of the surfaces of said web before it passes into a first one of said calendering nips in said calender to produce in said web a moisture gradient between at least one of the surface layers of said web and its interior portions, and utilizing said moisture gradient in addition to said temperature gradient in the calendering of said web.

4. The method of claim 1 wherein said significant temperature differential between said opposite surface layers of said web produce by said heating means is on the order of about 50° C.

5. The method of claim 1 further including cooling another of said calender rolls defining a calendering nip to produce said significant temperature differential.

6. The method of claim 1 wherein said at least one of said calender rolls are heated electromagnetically by induction heating utilizing said heating means, said heating means comprising magnetic shoe devices being in non-contacting relationship with said calender rolls heated thereby.

7. The method of claim 6 including the further step of controlling the transverse profile of said web being calendered by controlling the temperature profile in the axial direction of the mantle of said calender roll being heated by said heating means.

8. The method of claim 1 wherein said calender further includes guide means for selectively adjusting the direction of the web being introduced into a first calendering nip, and including the further step of adjusting said temperature gradient in said web in said first calendering nip by adjusting the position of said guide means to selectively adjust the direction of the web.

9. The method of claim 1 wherein said linear loads in said calendering nips have a value within the range of between about 20 to 200 kN/m, a lowest linear pressure acting in a vertically uppermost calendering nip and a highest linear pressure acting in a vertically lowermost calendering nip or in the only nip of a single-nip calender.

10. The method of claim 1 wherein the temperature of one of said calender rolls defining a calendering nip is in the range of between about 110° C. to 250° C. and wherein the temperature of another one of said calender rolls defining said nip is in the range of between about 40° to 50° .

11. The method of claim 10 wherein said rolls having a temperature in the range of between about 110° C. to 250° C. are outer rolls of said calender and wherein said rolls having a temperature in the range of between about 40° to 50° C. are inner rolls of said calender, and wherein said web has a temperature on the order of about 50° C. prior to being introduced into a first calendering nip.

12. A calender for calendering a web, comprising:

a calender stack including at least two calender rolls situated substantially one over the other defining at least one calendering nip between them in which the web to be calendered is pressed at a suitable linear load, said stack of calender rolls including outer rolls provided with internal means for variably adjusting the crowns thereof;

means for heating the mantle of at least one of said calender rolls defining a calendering nip to produce in the web passing therethrough a significant temperature differential in the thickness direction of said web between its interior portions and its surface layers and/or between its opposite surface layers to produce a temperature gradient over the thickness of the web, said heating means being situated externally of and in non-contacting relationship with said calender rolls eated thereby;

said temperature gradient being sufficient to act on the plastic properties of said web to be calendered to compensate for mechanical calendering work based on linear loading of said calender rolls, and wherein said heating means are arranged to control the transverse thickness profile of said web by changing the radius of said at least one of said calender rolls by varying its temperature.

13. The combination of claim 12 wherein said heating means are arranged for heating the mantles of a vertically uppermost and a vertically lowermost one of said calender rolls.

14. The combination of claim 12 wherein said heating means comprise means for electromagnetically heating the mantles of said calender rolls by inductive heating.

15. The combination of claim 14 wherein said heating means each include magnetic shoe devices comprising a plurality of core components situated one after the other in a direction transverse to the direction of web run.

16. The combination of claim 15 wherein each of said core components of a heating means is mounted for adjustable movement independently of the other core components to adjust the magnitude of an active magnetizing air gap defined between each core component and said calender roll to adjust the heating profile in the axial direction of said calender roll.

17. The combination of claim 12 wherein said calender includes a vertically uppermost calender roll, a vertically lowermost calender roll, each being provided with a respective heating means, said heating means heating a corresponding calender roll by electromagnetic induction means for inducing eddy currents in the mantle of the calender roll being heated, and at least two intermediate calender rolls situated between said uppermost and lowermost calender rolls.

18. The combination of claim 17 wherein said intermediate calender rolls comprise thermal-mantle rolls adapted to be connected to a source of temperature-control medium for heating and/or cooling said intermediate rolls.

19. The combination of claim 12 further including thermal insulation elements arranged substantially around said externally heated calender rolls, said thermal insulation elements being connected to a frame on which said heating means are mounted, said thermal insulation elements substantially surrounding a major part of the circumference of said calender rolls being heated.

20. The combination of claim 12 further including a cooling roll communicating with a source of cooling medium, said cooling roll being situated at an inlet side of said calender with said web contacting said cooling roll before it passes through a first nip of said calender.

21. The combination of claim 12 further including means for controllably moistening at least one of the surfaces of said web before it passes into a first one of said calender nips in said calender to produce in said web a moisture gradient between at least one of the surface layers of said web and its interior portion.

22. The combination of claim 12 further including guide means for selectably adjusting the direction of the web being introduced into a first calendering nip of said calender, said guide means comprising a guide roll mounted for positional adjustment, whereby said temperature gradient in said web is at least partly controllable by adjusting the position of said guide roll.

* * * * *